US005082697A

United States Patent [19]

Patton et al.

[11] Patent Number: 5,082,697

[45] Date of Patent: Jan. 21, 1992

[54] POLYMER SALT COMPLEX FOR FIBER OR FABRIC TREATMENT

[75] Inventors: Robert T. Patton, Lake Jackson, Tex.; David M. Hall, Auburn, Ala.; Walter L. Vaughn, Lake Jackson, Tex.

[73] Assignee: The Dow Chemical Company, Midland, Mich.

[21] Appl. No.: 520,489

[22] Filed: May 8, 1990

Related U.S. Application Data

[63] Continuation of Ser. No. 157,202, Feb. 17, 1988, abandoned.

[51] Int. Cl.[5] ..... B05D 3/02

[52] U.S. Cl. ..... 427/340; 162/158; 162/168.1; 427/341; 427/342; 427/389.9; 427/391; 428/253; 428/288; 428/290; 428/375; 428/392; 428/396

[58] Field of Search ..... 427/340, 341, 342, 389.9, 427/391; 428/288, 290, 253, 375, 392, 396; 162/158, 168.1

[56] References Cited

U.S. PATENT DOCUMENTS

| | | | |
|---|---|---|---|
| 3,404,134 | 10/1968 | Rees | 260/78.5 |
| 3,471,460 | 10/1969 | Rees | 264/94 X |
| 3,472,825 | 10/1969 | Walter et al. | 260/88.1 |
| 3,520,861 | 7/1970 | Thomson et al. | 156/326 X |
| 3,899,389 | 8/1975 | Vaughn et al. | 162/168 |
| 4,015,317 | 4/1977 | Johnsen | 28/72.6 |
| 4,173,669 | 11/1979 | Ashida et al. | 428/35 |
| 4,181,566 | 1/1980 | Vaughn et al. | 162/164 EP |
| 4,248,990 | 2/1981 | Pieski et al. | 526/317 |
| 4,279,961 | 7/1981 | Fujioka et al. | 428/328 |
| 4,351,931 | 9/1982 | Armitage | 526/227 |
| 4,447,570 | 5/1984 | Cook et al. | 156/334 X |
| 4,520,059 | 5/1985 | Worrall et al. | 428/109 |
| 4,599,392 | 7/1986 | McKinney et al. | 526/318.6 |
| 4,647,951 | 3/1987 | Yamori et al. | 346/200 |
| 4,661,634 | 4/1987 | Vaughn et al. | 564/292 |
| 4,855,354 | 8/1989 | Mohler et al. | 525/54.24 |
| 5,896,055 | 3/1972 | Long | 260/88.1 R |

OTHER PUBLICATIONS

*Rubber Chemistry and Technology*, pp. 1360–1367.

*Primary Examiner*—Michael Lusignan

[57] ABSTRACT

Natural or synthetic fibers (or fabrics, knits, papers, or webs made of such fibers) are improved in at least abrasion resistance, dye receptivity and/or other properties by bringing together on said fibers (or product made thereof) a liquid dispersion of a dispersible normally-solid polymer having pendent acid groups, such as carboxylic groups, and a reagent which reacts with the carboxylic group to render the polymer non-dispersible. The reagent may be one which supplies metal cations having a valence of at least 2 or it may be a primary amine, secondary amine or tertiary amine, or salts of the amine, a polyamine or salt thereof, or a quaternary ammonium salt. The reagent may precede the polymer onto the substrate, or may follow the application of the polymer onto the substrate.

23 Claims, No Drawings

POLYMER SALT COMPLEX FOR FIBER OR FABRIC TREATMENT

CROSS-REFERENCE TO RELATED APPLICATION

This is a continuation of application Ser. No. 07/157,202 filed Feb. 17, 1988, now abandoned.

FIELD OF THE INVENTION

Polymers containing pendent carboxylate salts are used in the treatment of fibers and fabrics.

BACKGROUND OF THE INVENTION

Copolymers of ethylene or of alpha-olefins (aka 1-alkenes) of $C_3$-$C_{12}$ with alpha, beta-ethylenically unsaturated carboxylic acids have been disclosed in patents and/or literature for many years. Copolymers of the olefins with esters of the carboxylic acid monomers have also been disclosed. Various methods have been disclosed for the preparation of these copolymers, including the copolymerization with one or more other copolymerizable monomers to make copolymers which may be called terpolymers, tetramers, and the like. The various methods have involved, for the most part, at least one of the following:

(1) the use of batch reactions of the pre-combined monomers, which usually leads to a non-uniform, non-homogeneous product because of differing reactivity rates of the monomers unless the conversion of monomers to copolymers is held to a very low percent:

(2) the making of block copolymers by alternately charging first one monomer, then another, into the reactor, allowing each charge to attain a significant percent of completion before the subsequent charge is added, thereby producing a highly-ordered, essentially non-random, chain comprised of "blocks" of a given monomer between "blocks" of a different monomer, each block normally containing a plurality of the given monomer groups:

(3) the copolymerizaton of pre-combined monomers fed into a portion of a non-stirred (or poorly-stirred) reactor while removing the formed polymers at a point in the reactor which is distal from the feed point, such as in a tubular reactor, thereby continuously producing polymers which, because of the differences in reactivities of the monomers and the non-uniformity of the reaction mixture throughout the reactor, does not provide a copolymer which is homogeneous and uniform and can even create homopolymer molecules among the copolymer molecules, especially if one of the monomers becomes completely converted before the other monomer does;

(4) the grafting of an unsaturated carboxylic acid (e.g., acrylic acid, methacrylic acid, crotonic acid, etc.) or a dicarboxylic acid (e.g. maleic acid, maleic anhydride, fumaric acid, itaconic acid, and the like) onto an organic polymer, such as an olefin polymer or copolymer (esp. polyethylene); and (5) feeding pre-combined monomers into a well-stirred, continuously operated autoclave reactor at substantially constant conditions of temperature, pressure, ratio of reactants, and flow-through, thereby continuously producing a copolymer which is substantially uniform and homogeneous, and in which the distribution of the acid groups along the polymer chain is random.

It is recognized in the art that copolymers made by polymerizing a mixture of monomers are often referred to as "interpolymers" because the monomers undergo polymerization simultaneously with each other, in contradistinction to those made by reacting a monomer with a previously formed polymer chain, such as block or graft copolymers.

For purposes of the preferred embodiment of the invention described hereinafter, the uniform, homogeneous, random copolymers are generally preferred, especially because batch-to-batch uniformity is more easily controlled in the present invention and because we have found that reactions involving the pendent acid groups are more readily optimized, due to the random distribution of the groups which avoids having a large population of the groups on adjacent carbon atoms along the polymer chain. Preparations of such copolymers are disclosed, e.g., in U.S. Pat. Nos. 3,520,861, 4,351,931, and 4,599,392. Even the so-called "non-random" copolymers produced in accordance with U.S. Pat. No. 4,248,990 have sufficient randomness of the pendent carboxyl groups to be useful in the present invention. An especially useful method for preparing an ethylene/unsaturated acid copolymer for reaction of the pendent carboxylic groups with an alkaline compound, such as caustic or an amine, is disclosed in U.S. Pat. No. 4,661,634.

It is known that ethylene copolymers having pendent carboxylic acid groups, especially ethylene/acrylic acid (or methacrylic acid) copolymers, can be reacted with NaOH or KOH to convert the —COOH groups pendent along the copolymer chain to —COONa or —COOK metal salt groups. It is also known that the pendent —COOH groups can be reacted with $NH_4OH$ to form —$COONH_4$ groups. The $H^+$ groups can also be replaced with other cations. Furthermore, it is known that ethylene/acrylic ester copolymers can be hydrolyzed to convert the ester groups to —COOH groups or can be saponified to convert the ester groups to —COONa groups and the like. The metal salt forms of ethylene/acrylic acid (or methacrylic acid) are known as ionomers. The monovalent metal and ammonium salt forms of the pendent acid groups are known to cause the polymer to be more easily dispersed in water to form a stable dispersion.

The use of counter-ions or reagents to replace an amine group or an ammonium group or a given monovalent metal cation, such as an alkali metal, especially $Na^+$ or $K^+$, with a polyvalent metal cation, such as $Co^{+2}$, $Cu^{+2}$, $Zn^{+2}$ $Mg^{+2}$, and others is known. The $Li^+$, $Rb^+$, and $Cs^+$ cations can be used as the monovalent cations, but they are less preferred and are more expensive than the $Na^+$ and $K^+$.

The use of aqueous dispersions of ethylene/acrylic acid and ethylene/methacrylic acid, and the like, and their salts, for treating fibers, such as wood, cellulosic or cotton fibers, and to treat paper and fabrics has been disclosed. Such treatments have involved applying the acid copolymers, or ionomers of the copolymers, to the fibers before shaping the fibers into a paper or fabric, or after shaping the fibers into a paper or fabric.

It is within the purview of the present invention to use a fine particle dispersion of any long-chain dispersible polymer comprising organic polymeric molecules having pendent acid groups which can be reacted with a reagent that replaces cations on the acid groups with cations which convert the dispersible polymer to a non-dispersible form; i.e., it is rendered non-dispersible in the liquid in which it had been previously dispersible.

This disclosure primarily relates the present invention with reference to the preferred carboxyl-containing ethylene copolymers, but the principle of converting a dispersible polymer having pendent acid groups to a non-dispersible form, by using a reagent which replaces cations on the acid groups, applies to other organic polymers, and provides useful modifications of fibers, fabrics, webs, paper, and the like.

We have now found that highly beneficial and unexpected results are obtained by applying the described polymers as dispersions to paper, nonwoven webs, yarns or fabrics (or to the fibers before making the paper, nonwovens, yarns or fabrics), and the like, while the polymers are in a dispersible form, e.g., the ionomer form (using a monovalent metal cation, ammonium, or amine form), then adding a reagent which converts the polymer to a non-dispersible form and "fixes" or "complexes" the polymer in place. Alternatively, the reagent which converts the polymer to a non-dispersible form may be applied to the paper, nonwovens, yarns or fabrics (or the precursor fibers of these) before the polymer dispersion is added.

SUMMARY OF THE INVENTION

In accordance with the present invention, fibers or yarns are treated with a dispersion of a dispersible form of an organic polymer having pendent acid groups, especially an olefin/unsaturated carboxylic acid (ECA) copolymer including those wherein the pendent carboxylic groups have been reacted with a compound which forms a monovalent cation salt of the acid group, such as those in the form of a monovalent cationic metal salt, amine salt, or ester form. The purpose of making the monovalent cation salt form of the ethylene/acid copolymer is to more easily provide the copolymer as a dispersible form. Any method of making a dispersion of the copolymer is operable so long as the pendent carboxylic group is reactable to form the desired non-dispersible salt after the dispersible form has been applied to the desired substrate(s). By "dispersible form" it is meant that the polymer is dispersible as fine particles in an appropriate liquid, especially water or a mixture of water and organic material. The liquid is considered appropriate if it carries or conveys the copolymer as fine particles into position in the fibrous structure where it is intended to be rendered non-dispersible by the action of the compound which is added for that purpose.

The so-treated fibers are formed into a paper, a nonwoven web, a yarn, or a.fabric, (either woven, knitted, or non-woven), and the like, and the copolymer is caused to react with a reagent which replaces the monovalent cation on the acid group with a metal cation of valence 2 or 3 or more (if it can be done at a pH which is not so low that the acid form of the carboxyl groups is regenerated), or with a cationic amine of higher polarity than the cation group on the water-dispersible copolymer, to produce a desired non-dispersible complex in situ on the fiber or yarn. The cation with a valence of 2 or 3 can be any metal ion having such valence, or can be a cationic radical comprising 2 or more elements, at least one of which elements is a metal. The cationic amine compound can be a primary amine, a secondary amine, a tertiary amine, a quaternary amine, a polyamine having at least 2 amine groups, or any compound which conforms to the generic formula $R^1R^2R^3R^4NX$, where each R is, independently, a hydrogen group and/or an alkyl group, ether group, ester group, or amine group containing from 1-20 carbons or more, so long as at least two of the R groups contain not more than about 5 carbon atoms, preferably not more than 2 carbon atoms, and where X represents an inorganic anion, such as a halide, or a negative valence radical, so long as the cationic amine is substantially soluble or dispersible as very fine particles in a polar solvent, especially water. Cyclic nitrogen compounds, such as morpholine or pyrolidine, amides, hindered amines, and the like can also be used. The quaternary amine salts are especially suitable because of good water solubility, providing good hydrophilicity, and good reactivity with the carboxylic groups, and yet forming a water-insoluble non-dispersible fiber-coating compound in accordance with this invention.

Alternatively, the fibers may already be in the form of a paper, yarn or fabric (either woven, knitted, or non-woven) or similar form before being treated with the copolymer in the dispersible monovalent salt form or the ester form, then the copolymer is caused to react with a reagent to produce the desired complex in-situ in and/or on the paper, yarn, or fabric. A yarn so-treated can then be woven, knitted, or hot-pressed into fabrics, cloths, webs or other desirable products including non-wovens.

Furthermore, the treatment of the fiber with both the dispersible ECA and then the reagent, can be done before the fibers are processed into a paper, yarn, fabric, web, or other product. Alternatively, the fibers can be treated with the reagent before the ECA dispersion is added so as to convert the ECA to a non-dispersible form. One may also, in some cases, bring the ECA and the reagent together in the dispersion, such as an ammonia-stabilized aqueous dispersion, so they may be added to the substrate simultaneously and then heated to cause them to react by driving off water and ammonia. The important thing is to have the reagent and the acid groups react in-situ on the substrate.

The paper, yarn, fabric, or web product prepared by the above method is believed to be novel and it is found to have excellent resistance to abrasion as well as other highly beneficial properties as a result of the present inventive method employed.

DETAILED DESCRIPTIONS INCLUDING BEST MODE

As used in this disclosure, the expression "natural or synthetic organic fibers" refers to fibers which are normally-solid, high molecular weight molecules which generally include at least some carbon and/or hydrogen atoms, and also include, in many cases, oxygen atoms, nitrogen atoms, or other atoms in the molecules. For instances, some examples of such natural fibers are cotton, flax, wood, hemp, silk, graphite, modified cellulosics (such as mercerized cotton), and the like. Examples of synthetic organic fibers include normally-solid polyolefins (e.g. polyethylene, polypropylene, polybutene, and the like), olefin copolymers, polyamides, polyesters, polycarbonates, polyvinyls, polysilanes, polysilicones and others. Normally-solid, fiber-forming, high molecular weight hydrocarbons are included here, in so far as fibers thereof are capable of being formed into a fabric, paper, web or other such article.

For purposes of conciseness, the expression "ECA" is used to signify an ethylene polymer containing carboxylic acid groups along the polymer chain. This includes polymers wherein there can be a minor amount of one or more other copolymerizable unsaturated monomers. A minor amount is an amount which is not present in sufficient amount to seriously affect the ability of the polymer to form dispersions when in the salt or ester form, and not seriously affect the exchange of cations or positive valence groups on the carboxylic acid groups along the polymer chain.

The carboxylic acid groups along the polymer chain can be those of acrylic acid, methacrylic acid, crotonic acid, or any of the alpha, beta-unsaturated carboxylic acids having up to about 12 carbon atoms. The preferred acids are acrylic and methacrylic, with acrylic acid being especially preferred. It is preferred that the polymer be one which is made in a process which produces a substantially uniform, random, homogeneous, interpolymer.

As used herein the expression "salt form", when referring to the water-dispersible form of ECA with which one performs the initial treatment step, refers to forms wherein at least an appreciable amount of the $H^+$ groups of the carboxylic acid have been replaced with a monovalent metal cation, ammonia group, or amine group or any group which can cause the ECA to be water-dispersible and form dispersions which are at least substantially stable. These salt forms are generally preferred over the ester forms of the acid groups, which are also called acrylate or methacrylate groups when the acid involved is acrylic acid or methacrylic acid, respectively. If the ester forms are used, it is preferred that the lower esters be used, such as the methyl, ethyl, propyl, butyl, or isobutyl esters. Unmodified ECA, wherein the —COOH groups have not had the $H^+$ ion replaced, are only marginally operable as the starting material for the first treatment step of the present invention, since it is difficult to form stable water dispersions; it is possible to form fine particles of ECA in water, but poor results and unstable dispersions are obtained unless the water contains ammonia, caustic, or some other reagent which, in effect, converts an appreciable amount of the —COOH groups to —COOM groups, where M represents the cation or positive valence group which comprises the salt.

Dispersions of the polymer in organic liquids or aqueous/organic liquids can be formed by using intensive shearing agitation of molten polymer in the liquid as the liquid is cooled to below the melting point of the polymer, or is precipitated, while stirring, by adding a nonsolvent to a solution of the polymer. The particular method of making the dispersion is not a part of the present invention; any method which results in a fine particle dispersion of the acid-polymer (or its salt form) may be used. There are intensive mixers, including colloid mills, which may be used to good advantage in obtaining fine dispersions.

The following descriptions relate to the preparation and use of aqueous dispersions of the preferred ECA polymers in the present invention, but the purview of the present invention is not limited to those particularly described below.

The amount of the pendent carboxylic acid groups in the preferred ECA polymer should constitute about 4% or more by weight of the total polymer weight, since below that amount the ECA is not as easily caused to be water-dispersible and extra measures may be needed to form the dispersion. The highest percent of the pendent carboxylic acid groups which is recommended for use in the present invention is about 45% by weight, since above that amount one is likely to encounter difficulties in producing a polymer of the desired molecular weight and one also approaches the level at which the ECA cannot be rendered non-dispersible. While marginal results can be obtained as low as about 2% of the acid, the preferred range is about 4% to about 45%, more preferably about 6% to about 25%. The molecular weight of the ECA polymer should be high enough that it is a solid at ambient temperatures and at temperatures to which the treated fabric may be exposed during normal use, handling, and cleaning. For this reason the molecular weight should be great enough to assure that the ECA polymer has a melting point not less than about 70° C., preferably greater than about 80° C. A molecular weight sufficient to provide a melt flow rate (MFR) of about 3 to about 4000 g/10 min., as measured in accordance to ASTM D-1238, is quite suitable for use in the present invention.

In preparing the dispersions, it is best if one begins with the ECA polymer in particulate form (such as powders or pellets) or fibrous form, thereby presenting a high surface area for reaction with the monovalent cations in preparing the water-dispersible ECA salts.

The reaction with the monovalent cations to form the dispersible salt form of the ECA, such as by reaction with caustic, ammonia, or amine, may be done well enough at room temperature if the concentration of the carboxylic acid in the ECA is high, i.e. about 30% or more, though application of heat does speed the reaction. It makes good sense to stir the reaction mixture to help create the dispersion. If the concentration of the pendent carboxylic acid is about 15% by wt. or lower, then one should use relatively high temperature of, say, up to about 70° C. or higher, but one should not venture too close to the boiling point of the carrier liquid or to the melting point of the polymer as that may cause agglomeration of the particles and require additional reaction solution and/or intensive stirring to re-disperse the polymer. If ammonia or other vaporous reactant is used in making the dispersion, provision may be made for trapping or condensing the vapors for further handling or recycling. A dispersion is formed which is substantially stable; it is recommended that the dispersion not be subjected to freezing temperatures unless it has been tested for freeze-thaw stability, since there may be some embodiments within the scope of the present invention which may be adversely affected by freezing.

The process of preparing the initial ECA salt (or ester, etc.) dispersion is not the subject of the presently claimed invention, and any process which one may use in preparing the ECA salt dispersion should be suitable, even though some processes can provide dispersions which are better suited for use in the present invention than are other processes. It is realized that the process of preparing the dispersion results in fine particle size polymer wherein the aggregations of polymer molecules have been substantially beneficiated into much smaller aggregates, probably because the formation of the ionomer created by reaction with caustic or ammonia, and the like, tends to swell the beginning particle and the beginning particle decrepitates into smaller particles. Some of the patent art refers to the action of caustic on the copolymers as being "digestion". Furthermore, the caustic, ammonia, and the like, lowers the surface tension of the water and this helps in the swelling of the beginning particle and also helps in stabilizing the resulting dispersion.

Among the reagents which can be used in providing the higher valence cations or groups are those which provide $Cu^{+2}$, $Co^{+2}$, $Mg^{+2}$, $Ca^{+2}$, $Ba^{+2}$, $Al^{+3}$, $Zn^{+2}$, $Cr^{+3}$, $Fe^{+2}$, $Fe^{+3}$, $Pb^{+2}$, $Sn^{+2}$, $Ru^{+2}$, $U^{+2}$, and the like, especially $Al^{+3}$, $Cr^{+3}$, $Mg^{+2}$, $Ca^{+2}$, and $Zn^{+2}$. In a general sense the reagent can be any compound which replaces the cation group on the ECA (which caused the ECA to be water-dispersible in the first place) with a group which causes the ECA to become substantially insensitive to water and renders it substantially non-dispersible in water, though it can remain water-wettable.

As used herein, the expression "complex", "complexed", or "complexes", refers to the effect obtained by reaction of anionic carboxyl groups on the polymer chain with polyvalent cationic metal or cationic amine groups, amides, cyclic nitrogen compounds, polyamines, or quaternary ammonium compounds, and the like, said complexes exhibiting significantly greater resistance to aqueous attack than the initial uncomplexed, water-dispersible ECA salts.

The quaternary ammonium compounds, which are the most preferred reagents for use in many of the embodiments of the present invention, can be any which have a molecular size sufficiently small enough to avoid steric hindrance and will permit the formation of the complex with ECA compound. In the formula $R^1R^2R^3R^4NX$, each R, is, independently, an alkyl group, an aryl group, or an aralkyl group having 1 to about 20 or more carbon atoms, so long as at least two of the R groups contain not more than 5 carbon atoms, preferable not more than 2 carbon atoms. It is also preferred that at least one of the R groups contain more than 3 carbon atoms, preferably more than 5 groups, because it appears that in some embodiments the larger R groups, being lipophilic, tend to beneficially associate with the fibers, especially the fibers of synthetic organic polymers or copolymers, such as olefin polymers, acrylic polymers, vinyl polymers, polyamides, polyesters, vinylidene chloride polymers, vinyl chloride polymers, cellulose acetate, cellulose triacetate, and the like. As mentioned hereinbefore, the X can be any inorganic anion, such as a halide, or a negative valence radical; among these negative valence radicals is $OH^-$ which is likely to be obtained when the quaternary amine compound is dissolved in water.

The fibers, papers, yarns, fabrics, webs, nonwovens, and the like which are treated or prepared in accordance with the present invention are found, among the various embodiments, to have benefited therefrom, such as in improved abrasion resistance, improved wetting (wicking) properties, improved water absorbtivity, improved dye receptance, improved tear-resistance, durability, fray resistance, run resistance, resilience, dimensional stability, dyeability, color retention (even to ozone and U.V. light), hand, static dissipation, yarn lubricity, sewing thread lubricity, yarn strength, fabric strength, faster loom speeds, fiber-to-fiber adhesion, bonding to latex or other adhesives (such as used on carpet backing), biocidal properties, and the ability to accept different kinds of dyes such as acid dyes and reactive dyes, thus facilitating uniform dyeing of fiber blends.

Whereas many of the descriptions herein are directed to the use of ethylene/acrylic acid (EAA) copolymers, it will be understood that other ethylene polymers containing pendent carboxylic acid groups are included in the acronym "ECA" which is used here in a generic manner for purposes of clarity and conciseness. Olefin comonomers other than ethylene can be used, but the descriptions used here are directed to the preferred ECA polymers.

THE PROCESS OUTLINED, IN GENERAL

The following outlines illustrate some generalized embodiments of the process of the present invention:

Process I

1. Prepare a dispersion of ECA in ammonia water; this converts at least a substantial portion of the —COOH groups to the ammonia salt form, $—COONH_4$ which aids in creating the dispersion.

2. Dilute the aqueous dispersion, if needed, to a level which provides an amount of polymer which is calculated to leave a pre-determined amount of polymer in/on the substrate when applied.

3. Soak the substrate (such as fibers, fabric, yarn, web, nonwoven, and the like) in the aqueous dispersion and remove excess dispersion by using a padder or other suitable method.

4. Dry the substrate at a temperature which does not adversely affect the materials. A drying temperature in the range of about 20° C. to about 100° C. is generally appropriate, assuming that the melting point of the polymer and/or substrate is not detrimentally surpassed. This drying substantially removes the water and most, if not all, of the ammonia groups, thus leaving the carboxylic groups in the acid form, —COOH.

5. Treat the substrate (such as by dipping or spraying) with a dilute aqueous solution of alkali metal hydroxide (such as NaOH) and remove excess solution, such as by running the fabric or fibers through a padder. This converts at least a substantial portion of the carboxylic groups to the alkali melt salt form, e.g. —COONa.

6. Treat the substrate (such as by dipping or spraying) with a dilute aqueous solution of the complexing reagent to replace at least a substantial portion of the alkali metal cations on the carboxylic groups, by ion exchange, with the cations supplied by the complexing reagent. The cations supplied by the complexing reagent may be metal cations of a valence of at least 2, or may be a cationic amine or amino group or may be a quaternary ammonium group.

7. Rinse the substrate in water to remove excess ions in the aqueous solution and "cure" the fabric or fibers at the temperature necessary to reduce the microporosity (if any) of the polymer film which had been deposited on the fabric or fibers. By the word "cure" we mean exposing the substrate to a heat history adequate to promote adhesion of the ionomer to the fibrous substrate.

Process II

1. Make a dispersion of the ECA in an alkali metal hydroxide solution or a combination of alkali metal hydroxide and ammonia solution. Dilute the dispersion to a concentration that will leave the desired amount of polymer in the final treated substrate.

2. Dip the substrate in the dispersion and then remove excess dispersion, such as by padding; a uniform coating of the dispersion is better assured by using a double immersion/double padding technique.

3. Dry the substrate.

4. Steam the substrate to swell the polymer layer.

5. Dip the substrate in a dilute reagent metal ion solution, or cationic amine (or amino) solution, or quaternary ammonium salt solution.

6. Rinse, dry, and cure the substrate at the temperature necessary to reduce the microporosity (if any) of the polymer film which has been formed on the substrate.

Process III

1. Prepare a dispersion of ECA and selected aqueous reagent, such as a metal hydroxide or cationic amine or amino compound, or a quaternary amine in ammonia and water. The selected metal hydroxide may be zinc hydroxide, cuprous hydroxide, or any other which will form a stable dispersion with the ECA in the presence of ammonia. Dilute the dispersion to a concentration which will leave the desired amount of polymer in/on the treated substrate.

2. Dip the substrate in the dispersion and then remove excess dispersion, such as by padding, such as in Process II.

3. Dry the substrate and cure at a temperature necessary to improve the film integrity of the polymer on individual fibers, such as by collapsing the polymer structure, facilitating the ionic bonding of, e.g., zinc and zinc amine complex cations to nearby carboxylic acid groups, reducing the micro-porosity, and the like.

Process IV

1. Prepare an aqueous ammonia ECA dispersion (preferably having at least a substantial portion of the acid in the ammonia salt form).

2. Dip the substrate in the dispersion and remove excess dispersion, such as in Process II.

3. Dip the substrate in an aqueous solution of quaternary amine or tertiary amine, preferably using a double immersion, double padding technique.

4. Dry the substrate and cure at a temperature necessary to improve the film integrity of the polymer on individual fibers, such as by collapsing the polymer structure, reducing the micro-porosity, and the like.

Process V

1. Add the reagent to the substrate.

2. An optional second step involves the drying and curing of the substrate as teated by step 1. This serves the purpose of solvent evaporation leaving a concentrated film of th reagent on the substrate surface. Furthermore, particularly in the case of sunthetics, interaction and partial solubility of the reagent with the substrate material can be effected by, after completion of drying, continuous, the substrate hearing so as to elevate its temperature to near the softening point and maintaining the temperature for several minutes.

3. Add the ECA dispersion to the substrate and achieve a reaction with the reagent which causes the ECA to coat the substrate and which renders the ECA non-dispersible.

4. Dip the substrate in an aqueous solution of quaternary amine or tertiary amine, preferably using a double immersion, double padding technique. This reacts more of the carboxylic acid groups in the polymer coating giving a higher degree of cross linking and more of the reagent functionality to the coating where this is desirable, An example where the reagent functionality imparts desirable character to the textile substrate is provided when the reagent is a quaternary amine. The additional quaternary amine groups reacted with the outer layers of the dispersion coating give a hydrophillic and cationic nature to the fabric thus improving its wettability, water absorbtivity and dyeability.

5. Dry the so-formed composite, preferably with a super-ambient temperature to form a cured polymer coating and to reduce the micro-porosity of the polymer.

The following examples illustrate certain embodiments of the present invention, but the invention is not limited to the particular embodiments illustrated.

EXAMPLE 1

A 25 wt. % dispersion of an ethylene/acrylic acid random copolymer (20% AA, 300 MFR) in aq. sodium hydroxide solution (i.e. the $Na^+$ ionomer form) is diluted with water to a concentration of 1%. Fabric samples of (A) 100% cotton sheeting, (B) 100% cotton toweling, (C) 50/50 polyester/ cotton sheeting, and (D) 70/30 polyester/cotton toweling are dipped into the dispersion and then padded to remove excess liquid. The padder squeeze pressure is adjusted to give approximately 75 wt. % gain (wet pickup) from the dispersion. In the following runs the solvent or carrier for the ingredients is water unless otherwise stated. The wetted fabric is then further treated in various manners as follows with data being shown in Table I:

Run 1

The fabric is air dried and then dipped into a 2% by wt. solution of aluminum chloride. The treated fabric is then oven dried and rinsed in water. The treated fabric is washed with detergent, rinsed, dried, and tested.

Run 2

The fabric is air dried and then dipped into a 2% by wt. solution of 3/1 mole ratio of magnesium chloride/aluminum chloride. The treated fabric is then oven dried and rinsed in water. The treated fabric is washed with detergent, rinsed, dried, and tested.

Run 3

The fabric is oven dried and then dipped into a 0.5% by wt. sodium hydroxide solution at room temperature. The treated fabric is then rinsed in water. The treated fabric is then dipped into a 2% by wt. solution of aluminum chloride and oven dried at 80° C. The treated fabric is washed with detergent, rinsed, dried, and tested.

Run 4

The fabric is oven dried and then dipped into a 0.5% by wt. sodium hydroxide solution at room temperature. The treated fabric is then rinsed in water. The treated fabric is then dipped into a 2% by wt. solution of 3/1 mole ratio of magnesium chloride/aluminum chloride. The treated fabric is then oven dried and rinsed in water. The treated fabric is washed with detergent, rinsed, dried, and tested.

Run 5

The dispersion is changed to a 1% by wt. dispersion which is thiocyanogenated to make the resulting fabric treatment more hydrophillic. After the fabric is dipped in this solution, the fabric is oven dried and then dipped into a 0.5% by wt. sodium hydroxide solution at room temperature. The treated fabric is then rinsed in water. The treated fabric is then dipped into a 2% by wt. solution of aluminum chloride and oven dried at 80° C. The treated fabric is washed with detergent solution, rinsed, dried, and tested.

Run 6

The EAA dispersion is again changed to a 1% by wt. dispersion which is thiocyanogenated to make the resulting fabric treatment more hydrophillic. After this dip, the fabric is oven dried and then dipped into a 0.5% by wt. sodium hydroxide solution at room temperature. The treated fabric is then rinsed in water. The treated fabric is then dipped into a 2% by wt. solution of 3/1 mole ration of magnesium chloride/aluminum chloride. The treated fabric is then oven dried and rinsed in water. The fabric is washed with detergent solution, rinsed, dried, and tested.

Run 7

The EAA dispersion is changed to a 1.5% by wt. dispersion which is thiocyanogenated to make the resulting fabric treatment more hydrophillic. After this dip, the fabric is oven dried and then dipped into a 0.5% by wt. sodium hydroxide solution at room temperature. The treated fabric is then rinsed in water. The treated fabric is then dipped into a 1% by wt. solution of didecyl dimethyl ammonium chloride (a quaternary amine). The treated fabric is then oven dried and rinsed in water. The fabric is washed with detergent solution, rinsed, dried, and tested.

Run 8

A 1.5% by wt. thiocyanogenated EAA dispersion is used. After this dip, the fabric is oven dried and then dipped into a 0.5% by wt. sodium hydroxide solution at room temperature. The treated fabric is then rinsed in water. The treated fabric is dipped into a 2% by wt. solution of 3/1 mole ratio of magnesium chloride/aluminum chloride and then rinsed. The fabric is oven dried, washed with detergent solution, rinsed, dried, and tested.

Run 9

A 1% by wt. thiocyanogenated EAA dispersion is used. After this dip, with no intervening steps, the fabric is dipped into a 2% by wt. solution of aluminum chloride and then rinsed. The fabric is oven dried, washed with detergent solution, rinsed, dried, and tested.

Run 10

A 1% by wt. thiocyanogenated EAA dispersion is used. After this dip, with no intervening steps, the fabric is dipped into a 2% by wt. solution of 3/1 mole ratio magnesium chloride/aluminum chloride and then rinsed. The fabric is oven dried, washed with detergent, rinsed, dried, and tested.

Run 11

A 1% by wt. thiocyanogenated EAA dispersion is used. After this dip, with no intervening steps, the fabric is dipped into a 1% by wt. solution of the didecyl dimethyl ammonium chloride. The fabric is oven dried, washed with detergent solution, rinsed, dried, and tested.

In the following Table I, the Breaking Strength is measured in lbs. in accordance with ASTM D-1682 using the Grab/Break Method. The Abrasion resistance is measured in the Warp and Filling in accordance with ASTM D-1175 (Stoll Flex Method). The "Untreated Samples" in Table I are for comparison purposes and are not examples of the invention.

TABLE 1

| | | Grab Break | | Abrasion | | | Grab Break | | Abrasion | |
|---|---|---|---|---|---|---|---|---|---|---|
| Run | Fabric | Warp | Filling | Warp | Filling | Fabric | Warp | Filling | Warp | Filling |
| 1 | A | 58 | 40 | 854 | 781 | C | 78 | 39 | 4483 | 3440 |
| | B | 71 | 37 | 665 | 636 | D | 100 | 29 | 4469 | 536 |
| 2 | A | 71 | 58 | 980 | 943 | C | 88 | 51 | 5904 | 5400 |
| | B | 72 | 61 | 657 | 535 | D | 82 | 33 | 5237 | 539 |
| 3 | A | 51 | 34 | 1218 | 572 | C | 78 | 48 | 5824 | 1849 |
| 4 | A | 77 | 41 | 1036 | 879 | C | 100 | 62 | 4143 | 3757 |
| 5 | A | 39 | 36 | 449 | 308 | C | 73 | 45 | 4840 | 4628 |
| | B | 70 | 55 | 504 | 379 | D | 74 | 27 | 3683 | 780 |
| 6 | A | 58 | 51 | 874 | 720 | C | 80 | 53 | 3177 | 2844 |
| | B | 72 | 39 | 684 | 556 | D | 69 | 42 | 4143 | 569 |
| 7 | A | 75 | 60 | 4990 | 3086 | C | 88 | 58 | 11765 | 9817 |
| | B | 96 | 40 | 1041 | 990 | D | 105 | 36 | 4874 | 554 |
| 8 | A | 82 | 68 | 801 | 728 | C | 92 | 49 | 3632 | 2272 |
| | B | 72 | 62 | 382 | 245 | D | 101 | 29 | 4316 | 587 |
| 9 | B | 42 | 31 | 292 | 255 | D | 93 | 43 | 4291 | 488 |
| 10 | B | 70 | 51 | 806 | 201 | D | 107 | 47 | 3556 | 3163 |
| 11 | B | 73 | 38 | 1681 | 762 | D | 107 | 45 | 6861 | 864 |
| Untreated | A | 79 | 59 | 646 | 519 | C | 96 | 68 | 2334 | 1278 |
| Controls | B | 82 | 62 | 162 | 141 | D | 113 | 39 | 5600 | 524 |

EXAMPLE 2

A 25 wt. % dispersion of an ethylene/acrylic acid random copolymer (20% AA, 300 MFR) in aqueous ammonia solution (i.e. the $NH_4+$ complex form) is diluted with water to three different concentrations, 1.3 wt. %, 2.00 wt. %, and 2.7 wt. %. Fabric samples of 4 oz./yd$^2$. 100% cotton sheeting are dipped into the dispersions and then padded to remove excess liquid. The padder squeeze pressure is adjusted to give approximately 75 wt. % gain (wet pickup) from the dispersion. Samples were subjected to a double dip and double nip procedure for uniformity of treatment. The wetted fabric samples are then further treated each with a different quaternary amine in order to determine the physical property variations thus imparted. The fabric samples are air dried and then cured at 105° C. for 15 minutes in a forced air convection oven. The treated fabric samples are washed in a Sears model 2000 washer using a D cycle and 0.5% OWF (on weight fabric) with phosphate laundry detergent such as Tide*. Fabric samples are then tumbled dry in a Kenmore dryer. Sample A5 is a control sample with no polymer and no quat added and no time in heated oven.

*Tradename of commercial product protected by copyright.

In the following Table II, the Breaking Strength is measured in lbs. in accordance with ASTM D-1683 using the Grab/Break Method. The Abrasion re-sistance is measured in the Warp and Filling directions in accordance with ASTM D-1175 (Stoll Flex Method). The three quaternary amines used are (1) Dimethyl Difatty Ammonium Chloride, (2) Stearyl Dimethyl Benzyl Ammonium Chloride, and (3) Dimethyl Didecyl Ammonium Chloride. Each quat concentration is 2%.

samples and is tested for comparative physical properties as shown in Table III.

In the following Table III, the Breaking Strength is measured in lbs. in accordance with ASTM D-1682 using the Grab/Break Method. The Abrasion resistance is measured in the Warp and Filling directions in accordance with ASTM D-1175 (Stoll Flex Method). The tear strength is measured in lbs. in accordance with ASTM 1424 using the Elmendorf Pendulum Method. Dimensional stability is measured by physical measurement of fabric samples before and after treatment and comparing the before and after dimensions using AATCC test method 135-1978.

TABLE II

| Polymer Loading Levels | | | | | | | | | |
|---|---|---|---|---|---|---|---|---|---|
| Sample No. | Target Loading | % Polymer Dispersion | Dry Pickup Wt. % | Quat Dip | Min. @ 105° C. | Tensile St. Warp, Lbs. | Tensile St. Fill, Lbs. | Abrasion Warp, Cyc. | Abrasion Fill, Cyc. |
| A2C | 1.0% | 1.3% | 1.0% | (1) | 15 | 70 | 59 | 8218 | 6961 |
| A2D | 1.0% | 1.3% | 1.0% | (2) | 15 | 73 | 64 | 9438 | 6810 |
| A2S | 1.0% | 1.3% | 1.0% | (3) | 15 | 71 | 59 | 8256 | 5839 |
| A3C | 1.5% | 2.0% | 1.5% | (1) | 15 | 70 | 58 | 8717 | 6294 |
| A3D | 1.5% | 2.0% | 1.5% | (2) | 15 | 70 | 59 | 11678 | 6009 |
| A3S | 1.5% | 2.0% | 1.5% | (3) | 15 | 70 | 38 | 8580 | 8385 |
| A4C | 2.0% | 2.7% | 2.0% | (1) | 60 | 70 | 59 | 6094 | 5833 |
| A4D | 2.0% | 2.7% | 2.0% | (2) | 60 | 70 | 61 | 10618 | 7133 |
| A4S | 2.0% | 2.7% | 2.0% | (3) | 60 | 70 | 56 | 10056 | 6342 |
| A5 | 0 | 0 | 0 | N.S. | N.A. | 78 | 59 | 629 | 484 |

EXAMPLE 3

A 10 wt. % dispersion of an ethylene/acrylic acid random copolymer (20% AA, 15 MFR) in aqueous ammonia solution (i.e. the $NH_4+$ complex form) is diluted with water to three different concentrations, 0.67 wt. %, 1.33 wt. %, and 2.00 wt. %. Fabric samples of 4 oz./yd$^2$. 100% cotton sheeting are dipped into the dispersions and then padded to remove excess liquid. The padder squeeze pressure is adjusted to give approximately 75 wt. % gain (wet pickup) from the dispersion. One sample is prepared using the same procedure but with an ethylene/acrylic acid random copolymer (20% AA, 300 MFR) in aqueous ammonia solution (i.e., the $NH_4+$ complex form) diluted to 2.0 wt. % concentration. The dispersion wetted fabric samples are then further treated with dimethyl didecyl ammonium chloride. The fabric samples are air dried and cured at 105° C. for 15 minutes in a forced air convection oven. Treated fabric samples are washed in a Sears model 200 washer using a D cycle and 0.5% OWF (on weight fabric) with phosphate laundry detergent. The fabric samples are tumbled dry in a Kenmore dryer. A control sample of untreated 4 oz. per square yard 100% cotton sheeting is washed and dried along with the treated

TABLE III

| Polymer Molecular Weight | | | | | | | | |
|---|---|---|---|---|---|---|---|---|
| Sample No. | MFR | % Polymer Dispersion | Dry Pickup Wt. % | Tensile St. Warp, Lbs. | Tensile St. Fill, Lbs. | Abrasion Warp, Cyc. | Abrasion Fill, Cyc. | Abrasion 30 Washings Warp, Cyc. |
| G1 | 15 | 0.67 | 0.5 | 74.5 | 60 | 7267 | 5838 | — |
| G2 | 15 | 1.33% | 1 | 72.5 | 62.5 | 6958 | 5262 | — |
| G3 | 15 | 2.0% | 1.5 | 78 | 64.5 | 10101 | 8295 | 4762 |
| Control 1 | 300 | 2.0% | 1.5 | 70 | 58 | 8580 | 6541 | 1038 |
| Control 2 | None | N.A. | N.A. | 78 | 59 | 646 | 519 | — |

| Sample No. | Abrasion 30 Washings Fill, Cyc. | Tear, Warp Lbs. | Tear, Fill Lbs. | Length Warp, In. | Length Fill, In. | Shrinkage Warp, % | Shrinkage Fill, % |
|---|---|---|---|---|---|---|---|
| G1 | — | 2.06 | 1.65 | 8.875 | 8.75 | 1.39 | 2.78 |
| G2 | — | 1.99 | 1.69 | 8.875 | 8.8125 | 1.39 | 2.08 |
| G3 | 3918 | 1.99 | 1.71 | 8.9375 | 8.8125 | 0.69 | 2.08 |
| Control 1 | 795 | 2.04 | 1.63 | — | — | — | — |
| Control 2 | — | 2.01 | 1.64 | 8.8125 | 8.3125 | 2.08 | 7.64 |

EXAMPLE 4

A 10 wt. % dispersion of an ethylene/acrylic acid random copolymer (20% AA, 300 MFR) in aqueous ammonia solution (i.e. the $NH_4+$ complex form) is prepared with a soluble zinc oxide complexed with $NH_4OH$ being present to the extent that the molarity of the zinc complex is sufficient to neutralize 85% of the carboxylic acid functionality in the copolymer when the polymer is dried and heated to drive off water and ammonia. Three different aqueous dilutions comprised of 0.75 wt. %, 1.5 wt. %, and 2.25 wt. % polymer are made of the original dispersion. Fabric samples of 4 oz./yd$^2$. 100% cotton sheeting are dipped into the dispersion and then padded to remove excess liquid. The padder squeeze pressure is adjusted to give approximately 100 wt. % wet pickup from the dispersion. The fabric samples are air dried and cured at 105° C. for 15 minutes in a forced air convection oven. The treated fabric samples are then washed in a Sears model 200 washer using a D cycle and 0.5% OWF (on weight fabric) with phosphate laundry detergent. Fabric samples are then tumbled dry in a Kenmore dryer.

In the following Table IV, the Breaking Strength is measured in lbs. in accordance with ASTM D-1682 using the Grab/Break Method. The Abrasion resistance is measured in the Warp and Filling directions in accordance with ASTM D-1175 (Stoll Flex Method). The Tear Strength is measured in lbs. in accordance with ASTM 1424 using the Elmendorf Pendulum method.

TABLE IV

| Sample No. | Dispersion Conc. Wt. % | Wet Pickup Wt. % | Dry Pickup Wt. % | Tensile St. Warp, Lbs. | Tensile St. Fill, Lbs. | Abrasion Warp, Cyc. | Abrasion Fill, Cyc. | Tear, Warp Lbs. | Tear, Fill Lbs. |
|---|---|---|---|---|---|---|---|---|---|
| A1 | 2.25 | 87 | 1.96 | 77 | 64 | 1628 | 852 | 3.85 | 2.74 |
| A2 | 1.5 | 94 | 1.41 | 76 | 62 | 941 | 669 | 3.06 | 1.98 |
| A3 | 0.75 | 95 | 0.71 | 78 | 69 | 870 | 717 | 1.77 | 1.22 |
| A* | None | N.A. | — | 78 | 59 | 612 | 449 | 2.81 | 1.64 |

A* is untreated control, not example of invention.

EXAMPLE 5

Samples of five fabrics of different composition are chosen for treatment and evaluation. The fabric sample designations and corresponding description are as follows: A—cellulose triacetate filament sharkskin, Testfabrics style 115; D—Dacron type 54, Testfabrics style 767, P—Spun polypropylene, Testfabrics style 976, and N—Spun nylon 6.6 DuPont type 200, Testfabrics style 361. Each of these samples is soaked out in a 1 wt. % solution of quaternary amine chosen for its demonstrated affinity for a broad spectrum of textile substrates and for the ability to render those substrates cationic and more wettable to aqueous systems. The quaternary amine chosen for this treatment is polyoxyethylene tallow ammonium chloride. The fabric samples are then padded to a 50% wet pickup by a double dip, double nip procedure. Each sample is then air dried followed by curing at the temperature and time interval shown in Table V. Then each sample is soaked in a 2 wt. % dispersion of ethylene/acrylic acid random copolymer (20% AA, 300 MFR) in aqueous ammonia solution (i.e., the NH4+ complex form). Following the soak, each sample is padded to a 50 wt. % wet pickup of the disperison. Still wet with the dispersion, each sample is soaked in a 1 wt. % solution of didecyl dimethyl ammonium chloride, dipped and padded twice to a 50 wt. % wet pickup. The samples are dried and then cured in a forced air convection oven at 105° C. for 15 minutes. The samples are washed in Sears model 200 washer using a D cycle and 0.5% OWF (on weight fabric) with phosphate laundry detergent. The fabric samples are then tumbled dry in a Kenmore dryer after which physical testing is performed.

In the following Table V, wettability is determined in accordance with AATCC test method 79-1979 by timing the interval required for a droplet of water to be completely absorbed by the fabric. Antistatic performance is measured using an ElectroTech Systems Model 406C instrument and Federal Test Standard 4046.1. Though the method was developed for barrier packaging films, its application for a variety of materials and sample configuration is now widespread. Each of the fabric samples was dyed in each of three dye systems using industry accepted dyeing procedures for each system. The three dyes used are CI (Color Index) Direct Blue No. 80, CI Acid Red No. 114, CI Reactive Blue No. 7.

TABLE V

Quaternary Amine Bond Treatment

| Sample No. | Dispersion Conc. Wt. % | Wet Pickup Wt. % | Dry Pickup Polymer Wt. % | Initial Quat Dip | Initial Quat Conc. | Quat Cure Temp. C. | Time at Temp. Min. | Final Quat Dip |
|---|---|---|---|---|---|---|---|---|
| A | 2 | 50 | 1 | TPEOAC | 2% | 120 | 15 | DMDDAC |
| A* Control | None | N.A. | N.A. | N.A. | N.A. | N.A. | N.A. | N.A. |
| D | 2 | 50 | 1 | TPEOAC | 2% | 160 | 15 | DMDDAC |
| D* Control | None | N.A. | N.A. | N.A. | N.A. | N.A. | N.A. | N.A. |
| P | 2 | 50 | 1 | TPEOAC | 2% | 115 | 15 | DMDDAC |
| P* Control | None | N.A. | N.A. | N.A. | N.A. | N.A. | N.A. | N.A. |
| N | 2 | 50 | 1 | TPEOAC | 2% | 160 | 15 | DMDDAC |
| N* Control | None | N.A. | N.A. | N.A. | N.A. | N.A. | N.A. | N.A. |

*Asterisks indicate untreated controls and are not examples of the invention.
NA means not applicable.

| Sample No. | Quat Conc. Wt. % | Dry Oven Temp. C. | Time at Temp Min. | Dyeability Dir. Blue 80 | Dyeability Acid Red 114 | Dyeability React. Blue 7 | Wettability Sec. | Static Decay Time, Sec. | Hand |
|---|---|---|---|---|---|---|---|---|---|
| A | 2 | 105 | 15 | Moderate | Good | Good | 6.3 | 5.7 | No change |
| A* Control | N.A. | N.A. | N.A. | None | Poor | Poor | 35.6 | No decay | — |
| D | 2 | 105 | 15 | Good | Good | Good | 0.6 | 6.1 | No change |
| D* Control | N.A. | N.A. | N.A. | None | Poor | Poor | 68 | No decay | — |
| P | 2 | 105 | 15 | Moderate | Good | Good | 0.5 | 9.2 | No change |
| P* Control | N.A. | N.A. | N.A. | None | None | None | * | No decay | — |
| N | 2 | 105 | 15 | Good | Good | Good | 1.9 | 2.2 | No change |
| N* Control | N.A. | N.A. | N.A. | None | Good | None | 541 | No decay | — |

*Sample never wetted

We claim:

1. A process for modifying a substrate comprising a fibrous material, or a paper, web, or fabric made of said fibrous material, said process consisting essentially of applying to said substrate a dispersible form of a normally-solid polymer having pendent acid groups, the dispersible form being dispersed in a liquid carrier, and a reagent selected from the group consisting of (a) tertiary amines or salts thereof, (b) quaternary ammonium salts, (c) primary amines or salts thereof, and (d) secondary amines or salts thereof, which reagent reacts with said dispersed polymer to render the polymer non-dispersible, and drying to remove the liquid carrier.

2. The process of claim 1 wherein the dispersible polymer is in the salt form.

3. The process of claim 1 wherein the dispersible polymer comprises an olefin polymer having pendent carboxylic groups.

4. The process of claim 3 wherein the acid groups on the olefin polymer are the pendent groups of an unsaturated carboxylic acid comonomer wherein said pendent groups comprise about 2% to about 45% by weight of the polymer.

5. The process of claim 3 wherein the acid groups on the olefin polymer are the pendent groups of an unsaturated carboxylic acid comonomer wherein said pendent groups comprise about 4% to about 45% by weight of the polymer.

6. The process of claim 3 wherein the acid groups on the olefin polymer are the pendent groups of an unsaturated carboxylic acid comonomer wherein said pendent groups comprise about 6% to about 25% by weight of the polymer.

7. The process of claim 1 wherein the substrate comprises fibers.

8. The process of claim 1 wherein the substrate comprises a fabric, either knitted, woven or non-woven, which is comprised of fibers.

9. The process of claim 1 wherein the substrate comprises paper which is comprised of fibers.

10. The process of claim 1 wherein the substrate comprises a web which is comprised of fibers.

11. The process of claim 1 wherein the dispersible polymer is in the sodium or potassium salt form.

12. The process of claim 1 wherein the reagent comprises a tertiary amine or salt thereof, a quaternary amine or salt thereof, a polyamine or salt thereof, or a quarternary ammonium salt.

13. The process of claim 1 wherein the reagent comprises a primary or salt thereof, or a secondary amine or salt thereof.

14. The process of claim 1 wherein the acid groups are provided by acrylic acid, methacrylic acid, crotonic acid, itaconic acid, or maleic acid.

15. The process of claim 1 wherein the acid groups are provided by acrylic acid or methacrylic acid.

16. The process of claim 1 wherein the acid groups are provided by acrylic acid.

17. The process of claim 1 wherein the dispersible polymer comprises copolymerized ethylene and acrylic acid.

18. The process of claim 1 wherein the dispersible polymer comprises a homogeneous, uniform, random copolymer of ethylene and acrylic acid or ethylene and methacrylic acid.

19. An article consisting essentially of a substrate coated with, or impregnated with, an olefin polymer having pendent carboxylic acid groups wherein said acid groups have been complexed with at least one reagent selected from the group consisting of (a) tertiary amines or salts thereof, (b) quaternary ammonium salts, (c) primary amines or salts thereof, and (d) secondary amines or salts thereof, wherein said substrate comprises natural or synthetic fibers, or fabric, paper, knits or web made of said fibers.

20. The article of claim 19 wherein said olefin polymer comprises a copolymer of ethylene and acrylic acid or methacrylic acid.

21. The article of claim 19 wherein the reagent is at least one tertiary amine or salt thereof, or polyamine or salt thereof, or quarternary ammonium salt.

22. The article of claim 19 wherein the reagent is at least one quarternary ammonium salt.

23. The article of claim 19 wherein the reagent is at least one primary amine or salt thereof, or secondary amine or salt thereof.

* * * * *